US007048161B2

(12) United States Patent
George

(10) Patent No.: US 7,048,161 B2
(45) Date of Patent: May 23, 2006

(54) ERGONOMICALLY CURVED WEAPON SLING

(76) Inventor: Kent J. George, 1606 Kirklee Rd., Charleston, WV (US) 25314

( * ) Notice: Subject to any disclaimer, the term of this patent is extended or adjusted under 35 U.S.C. 154(b) by 187 days.

(21) Appl. No.: 10/364,058

(22) Filed: Feb. 10, 2003

(65) Prior Publication Data

US 2004/0155076 A1 Aug. 12, 2004

(51) Int. Cl.
*F41C 23/02* (2006.01)

(52) U.S. Cl. ..... 224/150; 224/913

(58) Field of Classification Search ..... 42/85; 224/150, 600, 257, 258, 264, 913, 910
See application file for complete search history.

(56) References Cited

U.S. PATENT DOCUMENTS

| | | | | |
|---|---|---|---|---|
| 1,186,496 | A | 6/1916 | Randall | |
| 1,323,701 | A | 12/1919 | Lethern | |
| 2,116,618 | A * | 5/1938 | Crockett | 42/85 |
| 2,357,363 | A | 9/1944 | Smith et al. | |
| 2,481,884 | A | 9/1949 | Short | |
| 2,933,843 | A * | 4/1960 | McFeeter | 42/85 |
| 3,098,591 | A * | 7/1963 | Lerude | 224/150 |
| 4,148,423 | A * | 4/1979 | Schlacher | 224/258 |
| 4,562,945 | A * | 1/1986 | Erlandson | 224/150 |
| 5,282,558 | A | 2/1994 | Martinez | |
| 5,503,315 | A * | 4/1996 | Ruzika et al. | 224/257 |
| 5,615,811 | A | 4/1997 | Bell et al. | |
| 5,715,979 | A | 2/1998 | Crandall | |
| 5,718,363 | A | 2/1998 | Graves | |
| 5,806,733 | A * | 9/1998 | Smith | 224/264 |

FOREIGN PATENT DOCUMENTS

FR 2582490 * 12/1986

OTHER PUBLICATIONS

Backcountry Inc. website, Rifle Sling from OP/TECH USA, May 30, 2002, 4 pages.*
Cabela's, Cabela's 2003 Shooting Catalog, catalog, 2003, 2 pages, Reference No. XP-22-4872, U.S.

* cited by examiner

*Primary Examiner*—Stephen K. Cronin
(74) *Attorney, Agent, or Firm*—Adams Evans P.A.

(57) ABSTRACT

An ergonomic weapon sling includes an elongate strap having a preformed permanent curved shape adapted to conform to the anatomical contour of the user's body along an elongate area of contact between the strap and the body. First and second fasteners are carried on the strap for attaching to the forearm and stock of a rifle or shotgun. The sling is positionable in a carrying position in which the strap is positioned over a shoulder of the user and conforms to the contour of the user's torso, and is also positionable in an aiming position in which the strap conforms to the contour of an upper arm of the user and stabilizes the arm supporting the forearm of the weapon to aid the user in aiming the weapon.

14 Claims, 6 Drawing Sheets

ERGONOMICALLY CURVED WEAPON SLING

TECHNICAL FIELD AND BACKGROUND OF THE INVENTION

The invention relates to a sling for carrying a weapon, particularly a rifle or shotgun. The weapon sling of the invention has an ergonomically curved strap that conforms to the contours of the user's body. The ergonomic curvature of the weapon sling allows the user to comfortably carry the weapon, and reduces the tendency of the sling to slip off the shoulder of the user. In addition to carrying the weapon, the sling can be used in an aiming position in which the curvature of the strap conforms to the upper arm of the user in order to provide additional stability while aiming and firing the weapon, resulting in greater shooting accuracy.

A variety of prior art weapon slings have been developed to provide a means for conveniently carrying a weapon. For example, U.S. Pat. No. 5,282,558 discloses a gun sling which allows the firearm to be retained suspended from the shoulder without sliding off while the associated arm and hand are otherwise engaged. The gun sling of the '558 patent utilizes an auxiliary strap in conjunction with the sling's primary strap. However, such a two strap design is more expensive to produce, and is relatively cumbersome for the user to put on and remove. It is important that a weapon sling be easily removable in the event the user suddenly spots a fast moving target and time is of the essence. Therefore, a two strap design, such as the one disclosed in the '558 patent, can be problematic. Furthermore, the weight displacement brought about by the weapons attachment to the primary strap would continuously pull the auxiliary strap toward the primary strap, causing the auxiliary strap to uncomfortably wedge against the neck of the user.

U.S. Pat. No. 2,357,363 discloses a gun sling which can be used to aid the user in aiming and firing the weapon by cradling the triceps and elbow of the arm holding the weapon's forearm. The gun sling uses a D-ring to create an adjustable loop in the sling into which the user's upper arm can be inserted. The loop is then tightened around the upper arm. Such a design is significantly more complicated and cumbersome than the present invention.

In an effort to overcome and eliminate the aforementioned problems, the present invention was conceived.

SUMMARY OF THE INVENTION

Therefore it is an object of the present invention to provide an ergonomic weapon sling for comfortably and securely carrying a weapon, such as a rifle or shotgun.

It is another object of the invention to provide a weapon sling that includes a strap having a preformed curved shape that conforms to the contours of a human body, and resists slipping off of the user's shoulder.

It is yet another object of the invention to provide a weapon sling having a curvature that conforms to the contour of the user's upper arm, and provides support and stability to the user's arm holding the forearm of the weapon to improve accuracy while aiming and firing the weapon.

These and other objectives of the present invention are achieved by providing a weapon sling comprising an elongate strap having a preformed permanent curved shape adapted to conform to an anatomical contour of the body of a user of a weapon along an elongate area of contact between the strap and the user's body. First and second fasteners are carried on the strap for attaching to first and second spaced-apart attachment points on the weapon.

According to one preferred embodiment of the invention, the sling is positionable in a carrying position wherein the strap is positioned over a shoulder of the user and the weapon is carried on the user's back.

According to another preferred embodiment of the invention, the preformed curved shape of the strap conforms to a contour of the user's neck when the sling is positioned in the carrying position.

According to yet another preferred embodiment of the invention, the preformed curved shape of the strap conforms to a contour of the user's ventral torso when the sling is positioned in the carrying position.

According to yet another preferred embodiment of the invention, the preformed curved shape of the strap conforms to a contour of a lateral side of the user's torso when the sling is positioned in the carrying position.

According to yet another preferred embodiment of the invention, the sling is positionable in an aiming position wherein the preformed curved shape of the strap conforms to a contour of an upper arm of the user and the strap stabilizes the user's arm supporting a forearm of the weapon whereby the sling aids the user in aiming the weapon.

According to yet another preferred embodiment of the invention, the sling is positionable in a carrying position wherein the strap is positioned over a shoulder of the user to carry the weapon and the preformed curved shape of the strap conforms to a contour of the user's torso, and the sling is also positionable in an aiming position wherein the preformed curved shape of the strap conforms to a contour of an upper arm of the user and the strap stabilizes the user's arm supporting a forearm of the weapon to aid the user in aiming the weapon.

According to yet another preferred embodiment of the invention, the preformed curved shape of the strap comprises a series of preformed permanent curves in alternating directions for conforming to anatomical contours of the user's body along an elongate area of contact between the strap and the body.

According to yet another preferred embodiment of the invention, the sling includes means for adjusting a length of the strap.

According to yet another preferred embodiment of the invention, the strap is made of neoprene.

According to yet another preferred embodiment of the invention, the sling includes means for releasably attaching the first and second fasteners to the weapon.

According to yet another preferred embodiment of the invention, the sling is used in conjunction with a rifle or shotgun, and the first fastener is attached to the forearm of the rifle or shotgun.

According to yet another preferred embodiment of the invention, the second fastener is attached to the stock of a rifle or shotgun.

According to yet another preferred embodiment of the invention, the weapon sling comprises an elongate strap having first and second ends. The strap has a preformed permanent curved shape comprising a first curve extending from the first end of the strap in convex relation to the median plane of the user's body to conform to the contour of the user's neck, and a second curve extending from the first curve in concave relation to the median plane of the user's body to conform to the curvature of the user's ventral torso. First and second fasteners are carried on the strap for attaching to first and second attachment points on a weapon.

According to yet another preferred embodiment of the invention, the strap extends from the user's ventral torso to a lateral side of the user's torso and terminates at the lateral side.

According to yet another preferred embodiment of the invention, the sling is positionable in an aiming position wherein the first preformed curve of the strap conforms to a contour of an upper arm of the user and the strap stabilizes the user's arm supporting a forearm of the weapon to aid the user in aiming the weapon.

An embodiment of the method of carrying a weapon according to the invention comprises the steps of providing a weapon sling comprising an elongate strap having first and second ends. The strap has preformed curved shape comprising a first curve extending from the first end of the strap in convex relation to the median plane of the user's body to conform to the contour of the user's neck, and a second curve extending in concave relation to the median plane of the user's body to conform to the curvature of the user's ventral torso. First and second fasteners are carried on the strap for attachment to the weapon. The first fastener is attached to the forearm of the weapon, and the second fastener is attached to weapon's stock. The strap is positioned over a the user's shoulder such that the weapon is positioned on the user's back and the strap conforms to the contours of the user's neck and ventral torso.

An embodiment of the method for stabilizing a weapon while aiming according to the invention comprises the steps of providing a weapon sling comprising an elongate strap having a preformed permanent curved shape adapted to conform to the anatomical contour of the user's body along an elongate area of contact between the strap and the user's body. First and second fasteners are carried on the strap for attachment to the weapon. Attaching the first fastener to a forearm of the weapon, and attaching the second fastener to a stock of the weapon. Positioning the formed curve against the user's arm upper arm to stabilize the user's arm which is supporting the forearm of the weapon.

An embodiment of the method for making a weapon sling according to the invention comprises providing an elongate strap having first and second ends. Positioning a first fastener adjacent the first end and a second fastener adjacent the second end. Forming a curved shape in the strap for conforming to the anatomical contour of the user's body along an elongate area of contact between the strap and the body, and setting the curved shape in the strap so that the curved shape is permanently retained in the strap.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
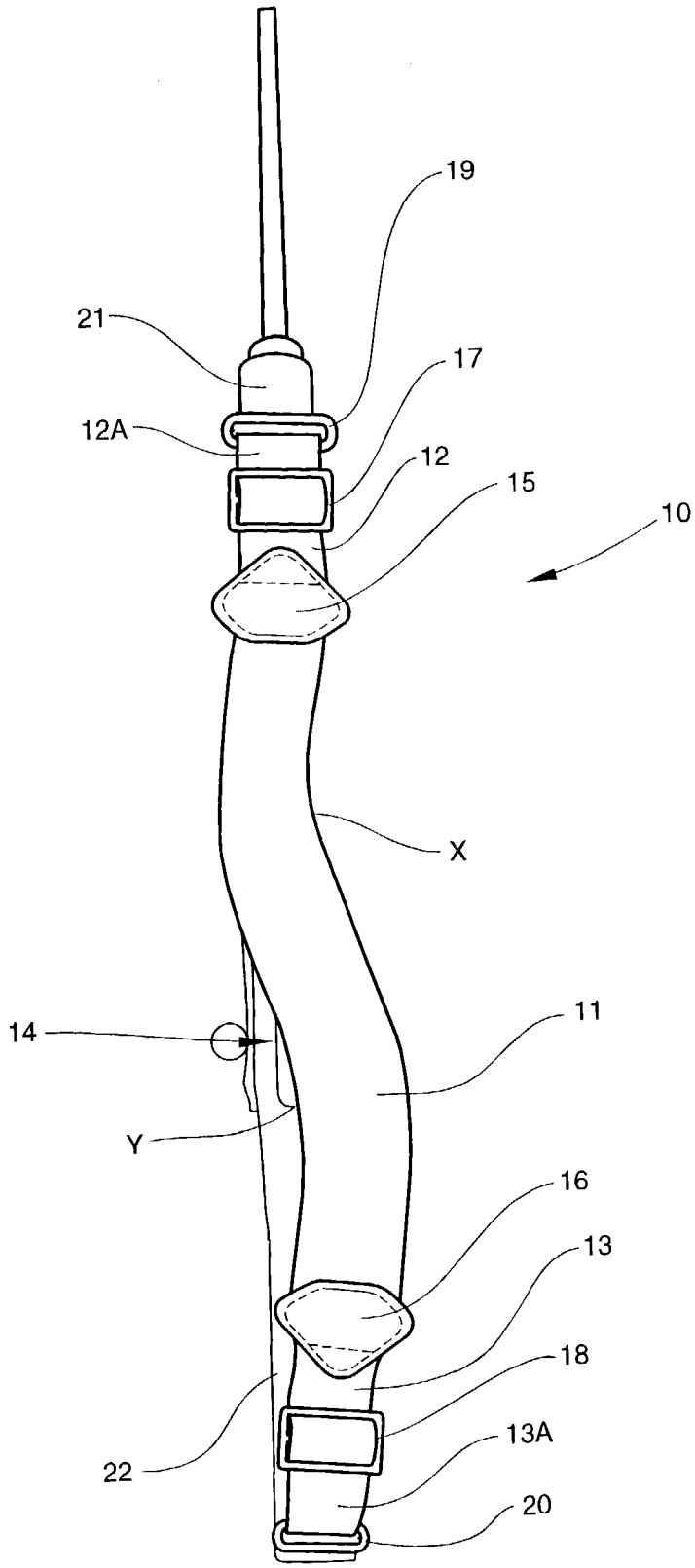
FIG. 1 is a front elevation of a preferred embodiment of the weapon sling according to the invention, shown attached to a rifle.

Referring now specifically to the drawings, a preferred embodiment of the weapon sling according to the present invention is illustrated in FIG. 1, and shown generally at reference numeral 10. The weapon sling 10 generally comprises an elongate strap 11 having a preformed curved shape that conforms to the anatomical contours of the typical adult human being, and two attachment straps 12, 13 for attaching to opposite ends of a weapon 14. The weapon 14 is preferably a rifle or shotgun.

As shown in FIG. 1, the elongate strap 11 includes two predominant curves X, Y in alternating directions to form a slight S-shape. The curves X, Y are preformed in the strap 11 such that the strap 11 permanently retains its S-curved shape.

Strap 11 is formed by cutting two identical pieces of material, preferably an elastic material such as neoprene, in the slight S-curve shape shown in FIG. 1. One of the pieces is then placed over the other in mirror image fashion, and the pieces are stitched together with nylon thread. Preferably, both sides of the strap 11 have a nurled surface.

Figure 4:
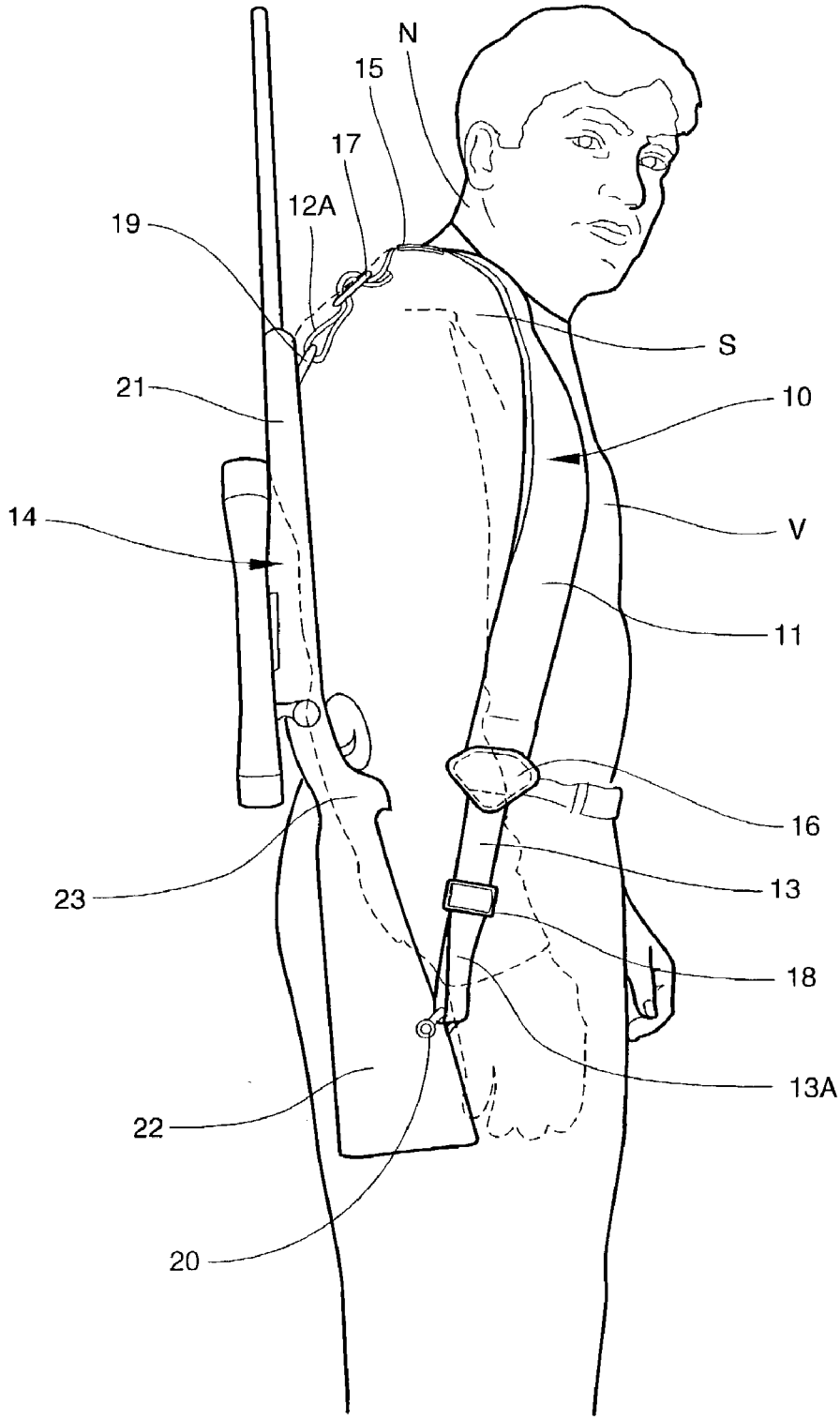
FIG. 4 is a right side elevation of the weapon sling of FIG. 2.
Figure 6:
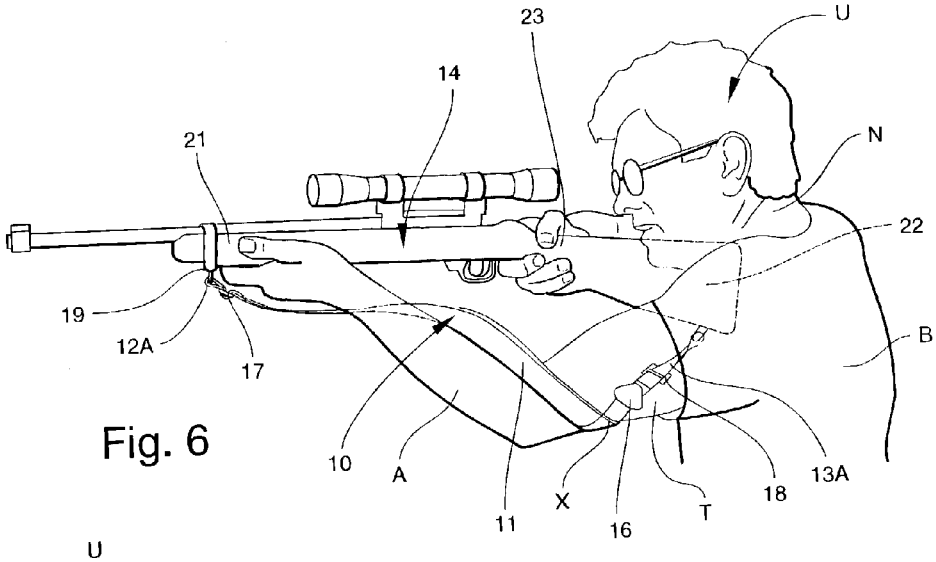
FIG. 6 is a left side elevation of the weapon sling of FIG. 1, shown positioned to assist the user in aiming and firing the rifle.
Figure 7:
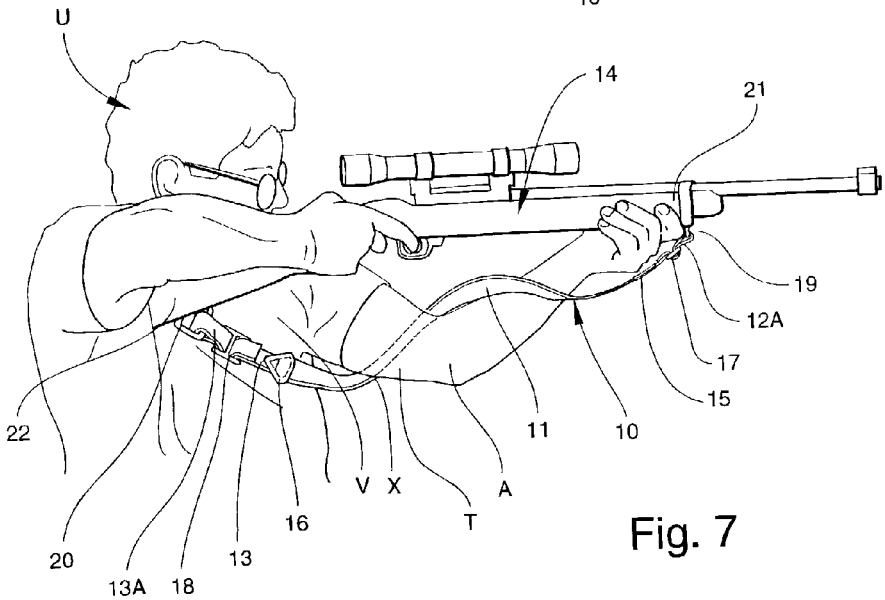
FIG. 7 is a right side elevation of the weapon sling of FIG. 1, shown positioned to assist the user in aiming and firing the rifle.

Opposite ends of the strap 11 are stitched to triangular shaped sheaths 15, 16, preferably made of plastic. The strap 11 is stitched, preferably with nylon thread, to the base sides of the triangular sheaths 15, 16. Attachment straps 12, 13 are stitched proximate the vertexes of the sheaths 15,16, respectively, and extend outward therefrom. The attachment straps 12, 13 are generally straight, and are preferably made of nylon. Each attachment strap 12, 13 is run through a D-ring 17, 18, respectively, to form a looped portions 12A, 13A, respectively. The looped portions 12A, 13A are for engaging swivels 19, 20, respectively, mounted on the forearm 21 and stock 22 of the rifle 14, respectively, as shown in FIGS. 4, 6 and 7. The sling 10 is attached to the weapon 14 running the attachment straps 12, 13 through swivels 19, 20, respectively, and then through the D-rings 17, 18, respectively, forming looped portions 12A, 13A. The sling 10 can be easily detached from the weapon 14 by pulling the attachment straps 12,13 back in the opposite direction, completely through their respective D-rings 17,18, thereby eliminating the loops 12A, 13A. In addition, the overall length of the sling 10 can be adjusted by varying the length of either attachment strap 12, 13 through its respective D-ring 17, 18.

Figure 2:
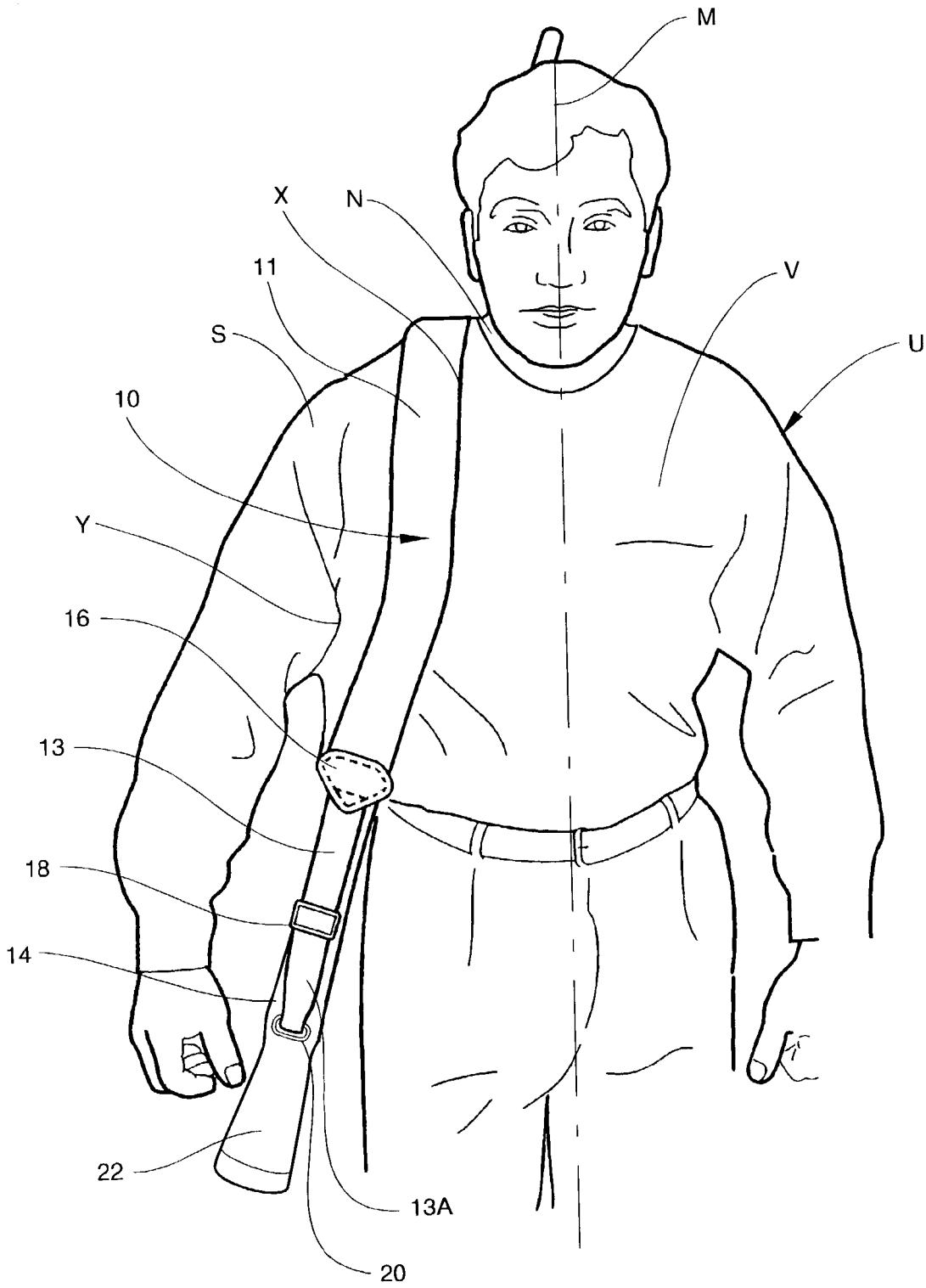
FIG. 2 is a front elevation of the weapon sling of FIG. 1, positioned on the right shoulder of a user.
Figure 3:
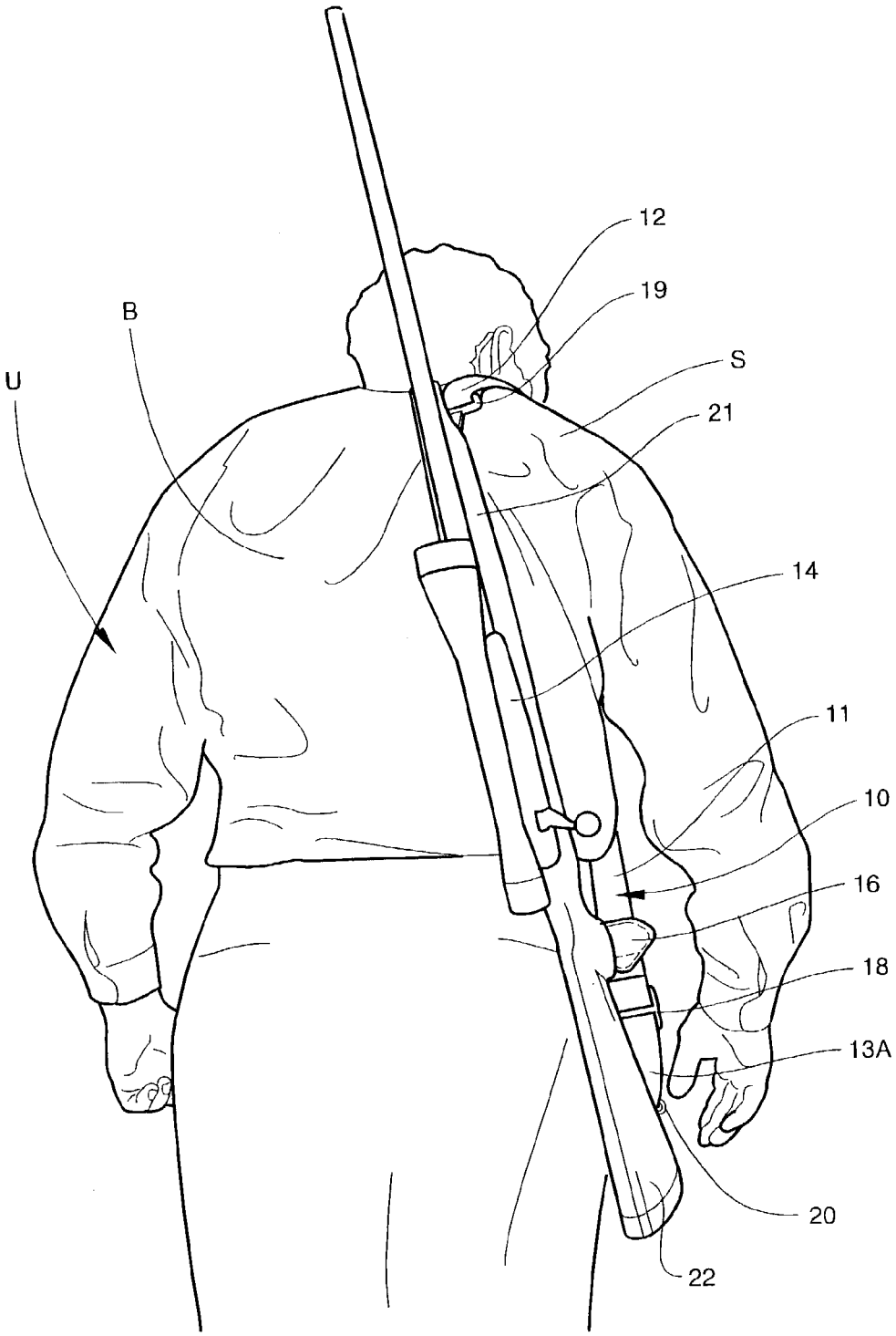
FIG. 3 is a rear elevation of the weapon sling of FIG. 2.
Figure 5:
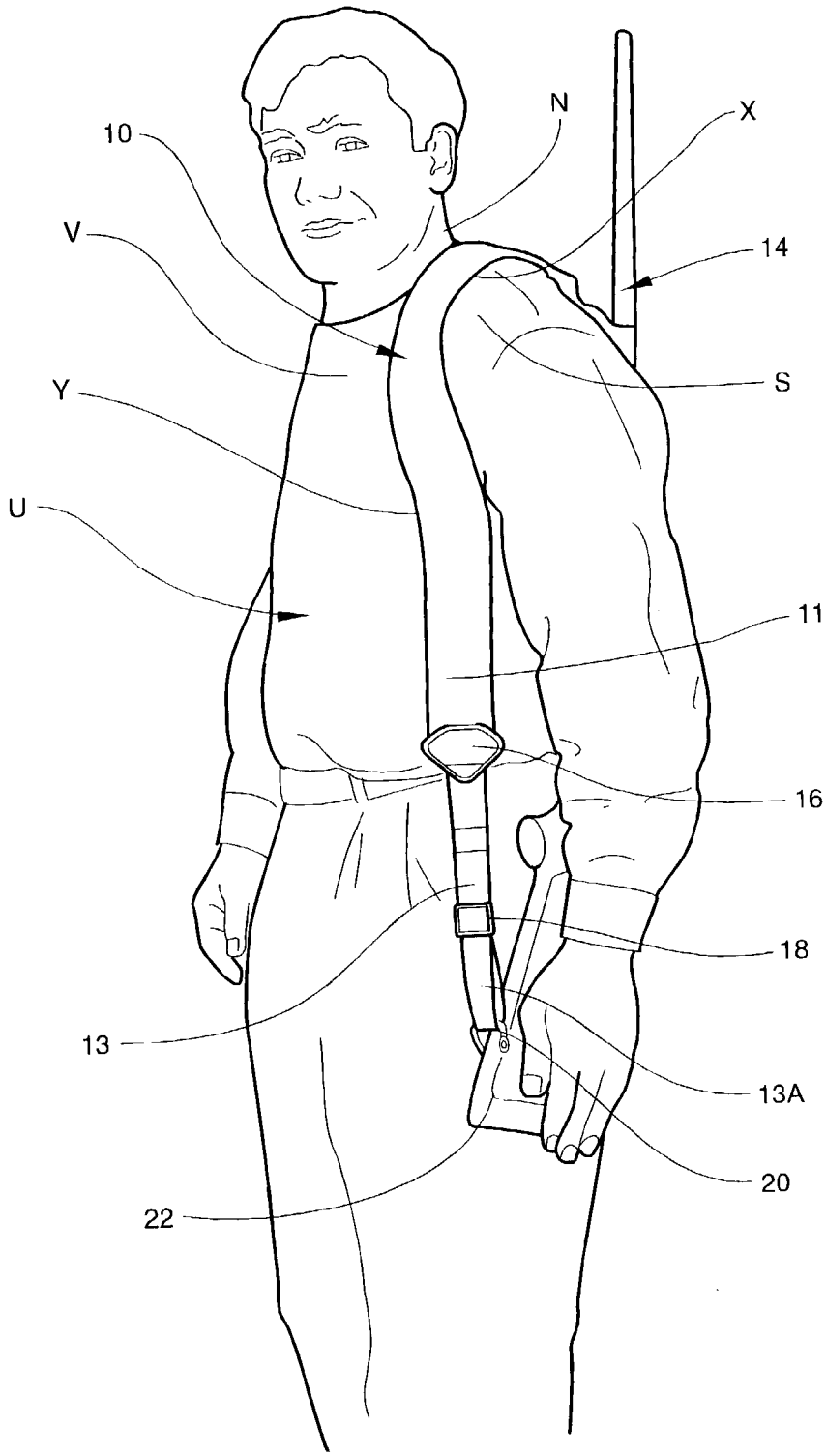
FIG. 5 is a perspective view of the weapon sling of FIG. 1, positioned on the left shoulder of the user.

As shown in FIGS. 2–5, the sling 10 is positionable in a carrying position in which the sling 10 is positioned over one shoulder S of the user U, and the weapon 14 is carried on the user's back B. As shown in FIG. 2, the first curve X of the strap 11 extends in convex relation to the median plane M of the user's body. The first curve X conforms to the contour of the user's neck N where the base of the neck N meets the shoulder S. The strap 11 then reverses direction to form curve Y extending in concave relation to the median plane M of the user's body to conform to the contour of the user's ventral torso V, as shown in FIG. 2. The strap 11 terminates at a lateral side of the user's torso, as shown in FIGS. 4 and 5. As such, the strap 11 has an ergonomic shape that comfortably supports the weapon 14. The ergonomic shape of the strap 11 also prevents slippage off of the user's shoulder S, which is common with conventional slings. As shown in FIGS. 4 and 5, the sling 10 can be positioned on either shoulder S of the user U.

As shown in FIGS. 6 and 7, the sling 10 is also positionable in an aiming position, in which the sling 10 aids the user U in aiming and firing the weapon 14. The user U assumes the conventional aiming stance with the stock 22 of the weapon 14 held firmly against the user's body, one hand holding the pistol grip 23, and the other hand holding the forearm 21 of the weapon 14. The strap 11 is positioned on the arm A of the user U holding the forearm 21 of the weapon 14. It is common for this arm A to become fatigued if the user U maintains the aiming position for a substantial length of time as this arm A is supporting most of the weight of the weapon 14. As shown in FIGS. 6 and 7, the strap 11 is positioned against the user's arm A such that the portion of strap 11 comprising curve X conforms to the contour of the user's triceps T. The strap 11 provides additional support and stabilizes the arm A holding the forearm 21 of the weapon 14. The strap 11 thereby improves the user's accuracy when aiming and firing the weapon 14 by reducing fatigue in the user's arm A and increasing the stability of the user's hold of the weapon 14.

An ergonomically curved weapon sling and methods for making and using same are disclosed above. Various embodiments of the invention can be made without departing from its scope. Furthermore, the foregoing description of the preferred embodiments of the invention and the best mode for practicing the invention are provided for the purpose of illustration only and not for the purpose of limitation—the invention being defined by the claims.

I claim:

1. A weapon sling for positioning over a shoulder of a user to carry a weapon on the user's back comprising:

(a) an elongate strap having first and second ends, said strap having a preformed permanent curved shape comprising a first curve extending from the first end of the strap in convex relation to a median plane of the user's body to conform to a contour of the user's neck, and a second curve extending from the first curve in concave relation to the median plane of the user's body to conform to a curvature of the user's ventral torso, and wherein the first curve extends convexly relative to an axis defined by the first and second ends of the strap at a substantially equal extent as the second curve extends concavely relative to said axis; and (b) first and second fasteners carried on said strap for attaching to first and second attachment points on a weapon.

2. A weapon sling according to claim 1, wherein the preformed curved shape of said strap conforms to a contour of a lateral side of the user's torso when said strap is positioned over a shoulder of the user and the weapon is carried on the user's back.

3. A weapon sling according to claim 1, wherein the preformed curved shape of said strap comprises a series of preformed permanent curves in alternating directions for conforming to anatomical contours of the user's body along an elongate area of contact between the strap and the body.

4. A weapon sling according to claim 1, further comprising means for adjusting a length of said strap.

5. A weapon sling according to claim 1, wherein said strap comprises neoprene.

6. A weapon sling accordlng to claim 1, further comprising means for releasably attaching said first and second fasteners to the weapon.

7. A weapon sling according to claim 1, wherein said strap extends from the user's ventral torso to a lateral side of the user's torso and terminates at said lateral side.

8. A weapon sling according to claim 1, wherein the weapon is a rifle or shotgun, and said first fastener is attached to a forearm of the weapon.

9. A weapon sling according to claim 8, wherein said second fastener is attached to a stock of the weapon.

10. A weapon sling according to claim 1, wherein said sling is positionable in an aiming position wherein said first preformed curve of said strap conforms to a contour of an upper arm of the user and said strap stabilizes the user's arm supporting a forearm of the weapon to aid the user in aiming the weapon.

11. A weapon sling according to claim 10, wherein the weapon comprises a rifle or shotgun and said first fastener is attached to a forearm of the weapon, and further wherein said second fastener is attached to a stock of the weapon.

12. A method for carrying a weapon comprising the steps of:

(a) providing a weapon sling comprising:

(i) an elongate strap having first and second ends, said strap having a preformed curved shape comprising a first curve extending from the first end of the strap in convex relation to a median plane of a user's body to conform to a contour of the user's neck, and a second curve extending in concave relation to the median plane of the user's body to conform to a curvature of the user's ventral torso, and (ii) first and second fasteners carried on said strap for attaching to the weapon;

(b) attaching said first fastener to a forearm of the weapon;

(c) attaching said second fastener to a stock of the weapon; and (d) positioning said strap aver a shoulder of the user such that the weapon is positioned on the user's back and said strap conforms to the contours of the user's neck and ventral torso.

13. A method for stabilizing a weapon while aiming, comprising the steps of:

(a) providing a weapon sling comprising:

(i) an elongate strap having a preformed permanent curved shape comprising a first curve extending from a first end of the strap in convex relation to a median plane of a user's body to conform to a contour of the user's neck, and a second curve extending in concave relation to the median plane of the user's body to conform to a curvature of the user's ventral torso, and (ii) first and second fasteners carried on said strap for attaching to the weapon;

(b) attaching said first fastener to a forearm of the weapon;

(c) attaching said second fastener to a stock of the weapon; and (d) positioning the formed curve against an upper arm of the user's arm to stabilize the user's arm supporting the forearm of the weapon.

14. A method for making a weapon sling comprising the steps of:

(a) providing an elongate strap having first and second ends;

(b) positioning a first fastener adjacent the first end and a second fastener adjacent the second end, said first and second fasteners for attaching to first and second attachment points on a weapon;

(c) forming a curved shape in said strap comprising a first curve extending from a first end of the strap in convex relation to a median plane of a user's body to conform to a contour of the user's neck, and a second curve extending in concave relation to the median plane of the user's body to conform to a curvature of the user's ventral torso; and (d) setting the curved shape in said strap whereby the curved shape is permanently retained in said strap.

* * * * *